US005209359A

United States Patent [19]

Arnold

[11] Patent Number: 5,209,359

[45] Date of Patent: May 11, 1993

[54] TENNIS EQUIPMENT SUPPORT RACK

[75] Inventor: William D. Arnold, St. Louis, Mo.

[73] Assignee: Lee/Rowan Company, St. Louis, Mo.

[21] Appl. No.: 848,716

[22] Filed: Mar. 9, 1992

[51] Int. Cl.[5] ..... A47F 7/00

[52] U.S. Cl. ..... 211/106; 211/14; 211/87

[58] Field of Search ..... 211/13, 14, 106, 88, 211/70.6

[56] References Cited

U.S. PATENT DOCUMENTS

| | | | |
|---|---|---|---|
| D. 313,138 | 12/1990 | Martinell et al. . | |
| 1,755,654 | 4/1930 | Kottke | 211/106 X |
| 2,923,415 | 2/1960 | Brown | 211/65 |
| 3,489,385 | 1/1970 | Dill | 211/106 X |
| 3,842,979 | 10/1974 | Doelcher | 211/14 |
| 4,004,526 | 1/1977 | King | 211/106 X |
| 4,467,925 | 8/1984 | Ratzloff et al. | 211/70.6 |
| 4,643,317 | 2/1987 | Wilkinson et al. . | |
| 4,655,351 | 4/1987 | Walker | 211/88 |
| 4,723,663 | 2/1988 | Learn | 211/70.6 X |

OTHER PUBLICATIONS

Racor catalog page.

*Primary Examiner*—Robert W. Gibson, Jr.

*Attorney, Agent, or Firm*—Rogers, Howell & Haferkamp

[57] ABSTRACT

A tennis equipment support rack has a fixed frame in combination with a basket. The fixed frame includes a single wire element that is bent to form a basket support rack. The basket has a front, a back, and two opposite side walls. At the upper edges of the side walls there is a continuous peripheral wire that functions as a flange portion by which the basket is supported on the basket support rack. The basket is for containing accessories of the game like balls, towels, sweatbands, and so on, and is easily freed from the basket support rack for transport. The fixed frame has another single wire element that is bent to form a tennis racket support rack. The tennis racket support rack can removably support one or several tennis rackets. The forms of both the fixed frame and the basket permit them to be nested with additional fixed frames and baskets.

21 Claims, 2 Drawing Sheets

FIG. 1.
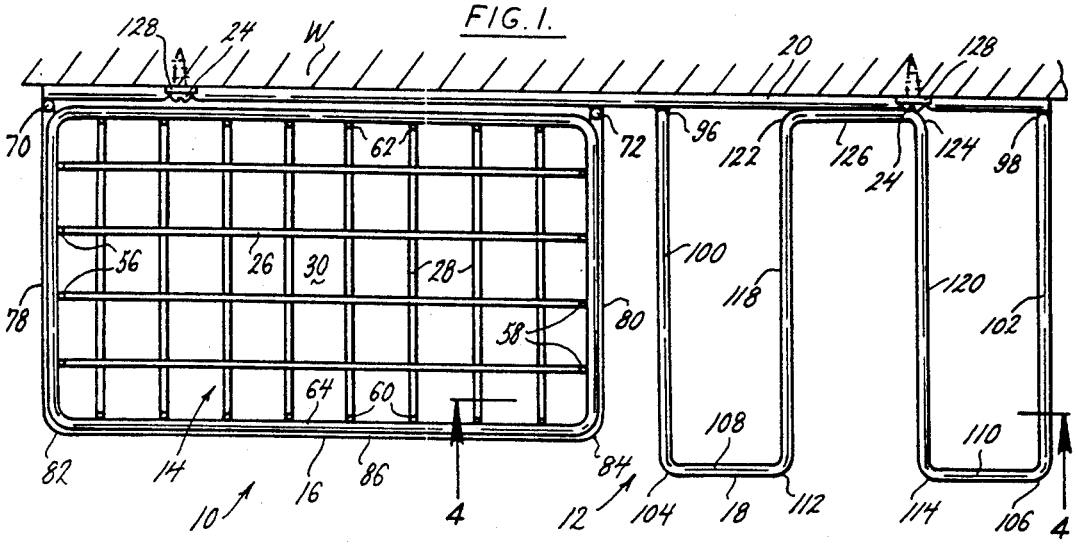
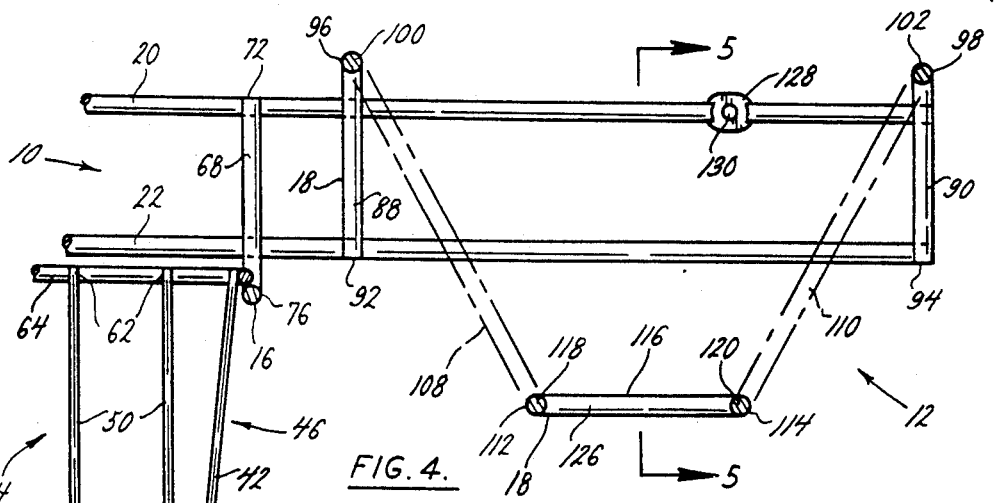
FIG. 4.
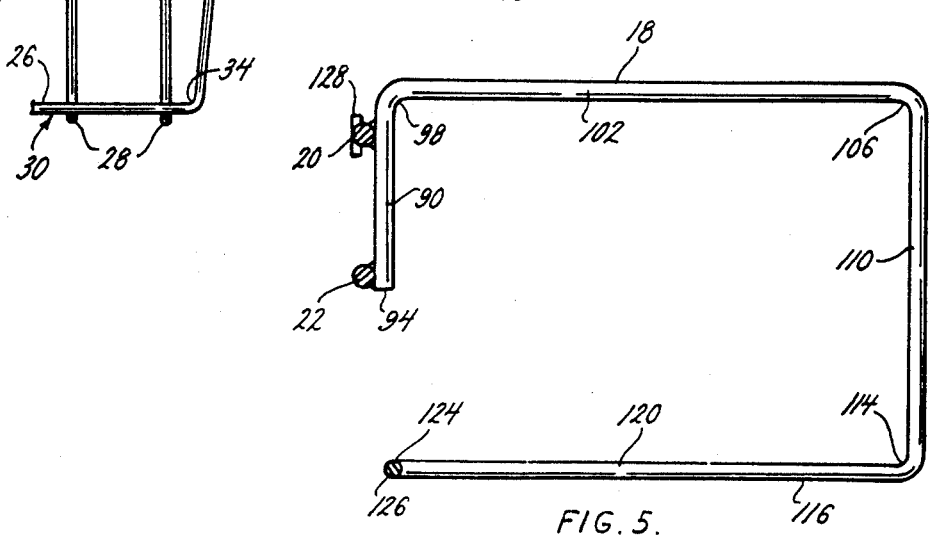
FIG. 5.

TENNIS EQUIPMENT SUPPORT RACK

BACKGROUND AND SUMMARY OF THE INVENTION

The present invention relates to a tennis equipment support rack and particularly to a tennis equipment support rack for mounting to a wall and for removably supporting a removable basket and one or several rackets.

Tennis equipment racks of the type to which the present invention relates are known in the art. These known racks are constructed of metal wire and sheet elements welded together.

This tennis equipment support rack is an improvement over the tennis equipment racks of the prior art. Advantages of the present invention include a basket support rack for removably supporting a basket and a tennis racket support rack which is formed from a single wire element. In addition, the basket support rack and the tennis racket support rack are integrated into one fixed frame, and this fixed frame has an overall configuration which permits it to nest with other like fixed frames. For like reasons, the removable basket has inclined walls, thereby enabling this basket to nest with other like baskets. Nestability has proven to be advantageous because it permits compact packaging for reduced shipping costs and permits a greater number of the fixed frames and baskets to be stocked on store display shelves and in inventory storage locations.

Therefore, when compared to the prior art, this tennis equipment support rack is more convenient to use, contains fewer wire elements and is less costly to manufacture. Furthermore, this tennis equipment support rack has nestable components which thus cost less to ship as well as permit greater numbers to be stocked in inventory and displayed at retail. These and more advantages are provided by the present invention without sacrificing appearance, strength or durability.

In accordance with the present invention, a tennis equipment support rack has a fixed frame in combination with a basket. The fixed frame includes a single wire that is bent to form a basket support rack. The basket has a front, a back, and two opposite side walls. At the upper edges of the side walls there is a continuous peripheral wire that functions as a flange portion by which the basket is supported on the basket support rack. The basket is for containing accessories of the game like balls, towels, sweatbands and so on, and is easily freed from the basket support rack for transport. The fixed frame has another single wire that is bent to form a tennis racket support rack. The tennis racket support rack can removably support one or several tennis rackets. The forms of both the fixed frame and the basket allow them to be nested with additional fixed frames and baskets. This nestability permits compact packaging for reduced shipping costs and permits a greater number of fixed frames and baskets to be stocked on store display shelves and in inventory storage locations.

BRIEF DESCRIPTION OF THE DRAWINGS

FIG. 1 is a top plan view of the tennis equipment support rack of the present invention.

FIG. 4 is an enlarged sectional view, with portions broken away, taken generally the line 4—4 of FIG. 1.

FIG. 5 is a sectional view takeh generally along the line 5—5 of FIG. 4.

DESCRIPTION OF THE PREFERRED EMBODIMENT

Figures 2, 3:
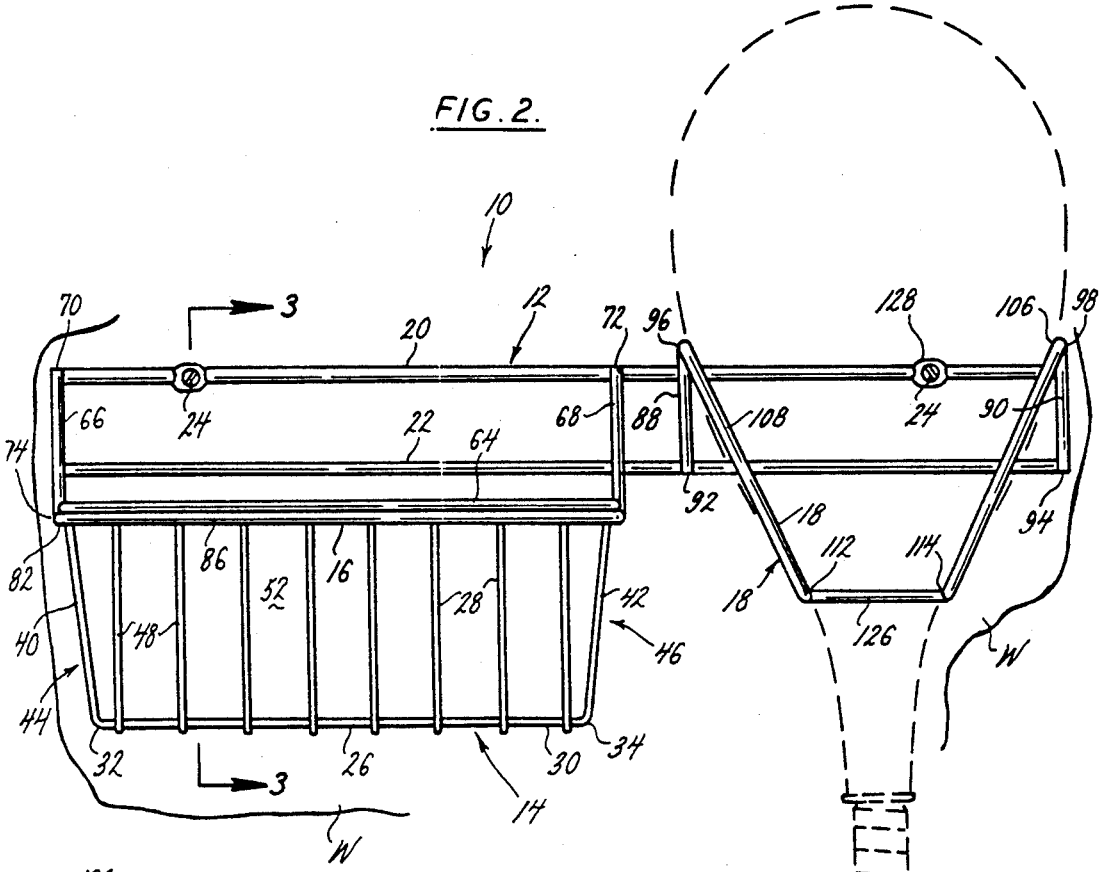
FIG. 2 is a front elevation view of the tennis equipment support rack with a tennis racket shown in broken lines to illustrate the removable support thereof.
FIG. 3 is an enlarged sectional view taken generally along the, line 3—3 of FIG. 2.

This tennis equipment support rack 10 includes a fixed frame 12 in combination with a removable basket 14. The fixed frame 12 generally comprises a single wire element bent as will be described to form a basket support rack 16, another single wire element bent as will be described to form a tennis racket support rack 18. The basket support rack 16 and the tennis racket support rack 18 are welded to a pair of upper and lower horizontal wire elements 20 and 22 that enable the resulting integral fixed frame 12 to be attached to a wall W, or like mounting structure, by screws 24, or like fasteners.

The basket 14 has a first set of spaced, parallel U-shaped wires 26 disposed transverse to and welded to a second set of spaced, parallel U-shaped longitudinal wires 28, to define a basket bottom 30. The transverse wires 26 have bends 32 and 34 that define the left and right margins of the basket bottom 32. Likewise, the longitudinal wires 28 have bends 36 and 38 that define the front and rear margins of the basket bottom. There are left and right arms 40 and 42 of the transverse wires 26 that extend generally upwardly from the first pair of opposite bends 32 and 34, and define left and right side walls 44 and 46. Similarly, there are front and back arms 48 and 50 of the longitudinal wires 28 that extend generally upwardly from the second pair of opposite bends 36 and 38, and define front and back walls 52 and 54. The left and right side walls 44 and 46 diverge outwardly and have terminal upper ends 56 and 58. Likewise, the front and back walls 52 and 54 diverge outwardly and have terminal upper ends 60 and 62. A flange element 64, consisting of a single continuous wire, extends outwardly from and is welded to the outer surfaces of the upper ends 56, 58, 60 and 62 of all four basket walls.

This flange element 64 is for stabilizing and maintaining the spans between adjacent basket wires 26 and/or 28, as well as between opposite basket walls. In addition, the flange element 64 has surface portions which define bearing surfaces for engagement with the basket support rack wire element 16, as described below.

The wire element 16 that defines the basket support rack includes a pair of horizontally spaced, vertical segments 66 and 68, which have terminal upper ends 70 and 72 and lower bent ends 74 and 76 (See FIG. 2). The vertical segments 66 and 68 are disposed on the upper and lower horizontal wire elements 20 and 22 as illustrated in FIG. 2, and at these places all are welded together. In addition, the wire element 16 has a pair of horizontally spaced, generally parallel side segments 78 and 80 that extend forwardly from the lower bent ends 74 and 76, and have forward bent ends 82 and 84. Finally, the wire element 16 has a front segment 86 that extends between and is joined to the forward bent ends 82 and 84. These three horizontally oriented segments 78, 80 and 86 of the first wire element 16 cooperate to define a loop frame upon which the basket flange element 64 can be supported, as generally illustrated in FIGS. 3 and 4. The transverse span of the flange element 64 is greater than the span between the vertical segments 66 and 68, and so the vertical segments 66 and 68 act as rearward stops that hold the front transverse span of the flange element 64 on top of the front wire segment 86.

The basket support rack 16 is configured to provide removable support for the basket 14. To facilitate this, the sides 40, 42, 48 and 50 of the basket are tapered, and the front segment 86 and side segments 78 and 80 of the basket support rack 16 define an opening sized to permit those portions of the basket 14 which are below the flange element 64 to pass therethrough.

The wire element 18 that defines the tennis racket support rack generally includes a pair of horizontally spaced, generally parallel and vertical segments 88 and 90, which have terminal lower ends 92 and 94 and bent upper ends 96 and 98. The vertical segments 88 and 90 are disposed on the upper and lower horizontal wire elements 20 and 22 as generally illustrated in FIG. 2, and at these places all are welded together. In addition, the wire element 18 has a pair of horizontally spaced, generally parallel and horizontal segments 100 and 102, which extend forwardly from and have rearward ends joined to the bent upper ends 96 and 98, and have forward bent ends 104 and 106. A pair of horizontally spaced segments 108 and 110 have upper ends integral with the forward bent ends 104 and 106, and extend downwardly while tapering toward each other to lower bent ends 112 and 114. Finally, the wire element 18 includes a generally U-shaped segment 116 comprising a pair of arms 118 and 120 with rearward bent ends 122 and 124 and a transverse segment 126 that extends between and has opposite ends joined to the rearward bent ends 122 and 124. This generally U-shaped segment 116 is horizontally oriented and extends rearwardly from and has forward ends joined to the lower bent ends 112 and 114.

These two pair of horizontally spaced, generally parallel and horizontal segments 100 and 102, and 118 and 120, of the second wire element 18 provide surface portions upon which the lower outside margins of racket heads can be removably supported, as generally illustrated in FIG. 2. In addition, these segments 100 and 102, and 118 and 120, have enough length to permit one or several tennis rackets to be removably and uprightly supported thereon.

The upper and lower horizontal wire elements 20 and 22 are vertically spaced and are generally parallel with one another. The upper wire element 20 is formed with a pair of flat portions 128, and is provided with a pair of fastener holes 130 through the flat portions 128. The pair of fastener holes 130 are disposed on the upper wire element 20 with about sixteen (16) inches between centers Thus the fastener holes 130 are so horizontally spaced as to permit the location of screws 24 on standard wall studs (not shown). The upper and lower horizontal wire elements 20 and 22 extend between and are welded to the vertical segments 66 and 68 of the wire element 16 and the vertical segments 88 and 90 of the wire element 18, as illustrated in FIG. 2.

The fixed frame 12 is nestable with like fixed frames 12 in close, vertically spaced relationships. This is possible because the diverging segments 108 and 110 of the tennis racket support rack 18 will permit one fixed frame 12 to nest with like fixed frames in close, vertically spaced relationships. Likewise, the inclined sides of the basket 14 make it nestable with like baskets. This nestability reduces shipping costs and permits greater numbers of products to be stocked in inventory locations and displayed on store shelves.

While the present invention has been described by reference to a specific embodiment, it should be understood that modifications and variations of the invention may be constructed without departing from the scope of the invention defined in the following claims.

What is claimed is:

1. A tennis equipment support rack comprising:

a basket having a front, a back, two opposite side walls and flange portions which extend outwardly from and have inner edges joined to the side walls, and a fixed frame for attaching to the front of a mounting structure and for removably supporting the basket, said fixed frame comprising:

first means for removably supporting the basket by said flange portions, second means for removably and uprightly supporting a plurality of rackets, and third means for attaching to the mounting structure and for securely supporting said first and second means.

2. The tennis equipment support rack of claim 1 wherein the second means comprises at least one pair of horizontally spaced first members which extend forwardly from and have rearward ends securely supported by said third means, and have forward ends;

said first members providing surface portions upon which the lower outside margins of racket heads can be supported.

3. The tennis equipment support rack of claim 2 wherein the second means further comprises a pair of horizontally spaced and tapering second members which extend downwardly from and have upper ends joined to said forward ends, and have lower ends; and a horizontally oriented, generally U-shaped member which extends rearwardly from and has a pair of forward ends joined to said lower ends.

4. The tennis equipment support rack of claim 3 wherein said fixed frame is nestable with other like fixed frames in close, vertically spaced relationships.

5. The tennis equipment support rack of claim 3 wherein the second means comprises a single metal wire.

6. The tennis equipment support rack of claim 5 wherein the third means is metallic and securely supports said second means by means of welded joints.

7. The tennis equipment support rack of claim 1 wherein the first means comprises at least a pair of horizontally spaced, generally horizontal members, each of which extends forwardly from and has a rearward end securely supported by said third means, and has a forward end;

said generally horizontal members providing surface portions upon which said flange portions can be supported.

8. The tennis equipment support rack of claim 7 wherein the first means further comprises a cross member which extends between and has opposite ends joined to the forward ends of said generally horizontal members;

said cross member and generally horizontal members defining an opening which is so sized as to permit those portions of the basket which are below said flange portions to pass therethrough.

9. The tennis equipment support rack of claim 8 wherein the basket has tapered sides to facilitate passage through the opening.

10. The tennis equipment support rack of claim 8 wherein the first means comprises a single metal wire.

11. The tennis equipment support rack of claim 10 wherein the third means is metallic and securely supports said first means by means of welded joints.

12. The tennis equipment support rack of claim 1 wherein the basket comprises criss-crossed metal wire elements welded together.

13. The tennis equipment support rack of claim 12 wherein the basket walls are inclined such that said basket is nestable with other like baskets in close, vertically spaced relationships.

14. The tennis equipment support rack of claim 12, wherein the side walls have upper edges, and said inner edges of the flange portions are joined to the side walls along said upper edges.

15. A tennis racket support rack for supporting tennis rackets of the kind having a head, a handle, and a throat where the handle joins the head comprising:

a unitary elongated element, and means for attaching to the front face of a mounting structure nd for securely supporting the elongated element, wherein the unitary elongated element includes at least one pair of horizontally spaced, generally horizontal and parallel segments that are spaced from one another by a margin significantly greater than the width of a racket throat and that have surface portions upon which outer edge margins of racket heads at points spaced from the throats of the rackets can be removably and uprightly supported.

16. The tennis racket support rack of claim 15 wherein the segments have rearward ends which are securely supported by the means and have forward ends; and the elongated element further includes:

vertical segments which have upper ends joined to the forward ends and taper downwardly to lower ends, and a horizontally oriented, generally U-shaped segment which extends rearwardly from and has a pair of generally parallel arms with forward ends joined to the lower ends.

17. The tennis racket support rack of claim 16 wherein both the horizontal segments and the arms of the U-shaped segment provide surface portions upon which the outer edge margins of racket heads can be removably and uprightly supported.

18. The tennis racket support rack of claim 17 wherein the elongated element is a single metal wire.

19. The tennis racket support rack of claim 18 wherein said means is metallic and securely supports said wire element by means of welded joints.

20. The tennis equipment support rack of claim 3 wherein:

the U-shaped member includes a pair of horizontal arms that are horizontally spaced apart, said arms have surface portions against which the outside margins of rackets can contact, whereby said horizontal arms of the U-shaped member orient the handles of removably supported rackets generally vertically.

21. The tennis equipment support rack of claim 16 wherein:

the arms of the U-shaped segment have bearing surfaces against which the outside margins of rackets can bear, whereby said bearing surfaces limit the angular deviation from vertical of the handles of removably supported rackets.

* * * * *